US006979222B2

(12) United States Patent
Comini

(10) Patent No.: US 6,979,222 B2
(45) Date of Patent: Dec. 27, 2005

(54) MOLDED ELECTRICAL CONNECTOR WITH PLURAL PAIRED INSULATION DISPLACEMENT CONTACTS

(75) Inventor: Riccardo Comini, Milan (IT)

(73) Assignee: Woodhead Industries, Inc., Deerfield, IL (US)

( * ) Notice: Subject to any disclaimer, the term of this patent is extended or adjusted under 35 U.S.C. 154(b) by 301 days.

(21) Appl. No.: 10/433,973

(22) PCT Filed: Nov. 20, 2002

(86) PCT No.: PCT/US02/37118

§ 371 (c)(1),
(2), (4) Date: Jun. 6, 2003

(87) PCT Pub. No.: WO03/047040

PCT Pub. Date: Jun. 5, 2003

(65) Prior Publication Data

US 2004/0029431 A1 Feb. 12, 2004

Related U.S. Application Data

(60) Provisional application No. 60/332,038, filed on Nov. 21, 2001.

(30) Foreign Application Priority Data

Nov. 21, 2001 (US) ..... 60/332,038

(51) Int. Cl.[7] ..... H01R 4/24; H01R 4/26; H01R 11/20; H01R 12/24

(52) U.S. Cl. ..... 439/404; 439/499; 439/395

(58) Field of Search ..... 439/404, 498, 439/465, 467, 492, 405, 499, 395

(56) References Cited

U.S. PATENT DOCUMENTS 5,174,782 A * 12/1992 Bogiel et al. ..... 439/404
5,551,889 A 9/1996 Kozel et al.
5,759,065 A 6/1998 Hatagishi et al.
6,129,574 A 10/2000 Okayasu et al.

* cited by examiner

*Primary Examiner*—Chandrika Prasad
(74) *Attorney, Agent, or Firm*—Emrich & Dithmar LLC

(57) ABSTRACT

An electrical connector includes first and second mating sections (17, 18). The first section (17) forms a plurality of channels (25–28) for receiving wires (12–15). The second section (18) has receptacles (24A–24D) for receiving contact elements (20–23) having IDC contacts for connecting respectively to the wires. The contact elements are constructed so that they may be placed in any one of four quadrature positions while providing a dual IDC connection with its associated wire.

4 Claims, 6 Drawing Sheets

MOLDED ELECTRICAL CONNECTOR WITH PLURAL PAIRED INSULATION DISPLACEMENT CONTACTS

RELATED APPLICATION

This application claims priority benefit of U.S. provisional application No. 60/332,038, filed Nov. 21, 2001.

FIELD OF THE INVENTION

The present invention relates to electrical connectors of the type used in manufacturing automation systems. In particular, the invention relates to improvements in a DIN molded connector for mounting to the body of a solenoid while providing electrical contacts for operating the solenoid. Such connectors are currently widely used in industrial automation systems. They comply with internationality recognized standards, as persons skilled in the art will appreciate.

BACKGROUND OF THE INVENTION

Connectors of the type with which the present invention is concerned typically have four (sometimes three) contacts. In the case of four contact elements, two may be used to conduct DC power, and the other two contacts may be used as connectors for data leads in a serial data network. The illustrated embodiment includes four separate contact elements. If it is desired to provide only three contacts, one data contact element is typically omitted.

In connectors of this type, there is a desire to make manufacturing more economical. In particular, it is desired to use insulation displacement contacts (IDC) in establishing the electrical connection between wires from a sheathed cable or cord to a printed circuit board, for example, within the body of the connector. Typically the connector body is provided with an insulating and protective plastic overmold covering all exterior surfaces except for the surface intended to be secured to the body of the solenoid or other device, and leaving a central opening for mounting the connector body to the solenoid body. Thus, the present connectors are frequently covered with a protective overmold and they may thus be referred to as "molded" connectors.

Connectors of this type may have connector elements including a bayonet type of external contact element for connecting to the corresponding contact elements (e.g., blades) of the solenoid or other device, such as a sensor, to which the instant connectors are attached. However, the contact blades on the solenoid body may be situated in different orientations in order to insure mating of associated connector elements; and it is, therefore, desirable that the external contact elements of the molded connectors be capable of being oriented in different directions during the manufacture of the molded connector so as to accommodate the various types of connector arrangements and designs found on control devices and to insure proper connections of the finished connectors.

It will be understood by persons skilled in the art that the control devices may have different contact orientations or contact configurations in order to avoid mistakes in connecting devices in the industrial automation network. It is thus desirable to have the various contact elements of the molded connector capable of being arranged in the desired orientations and combinations of connecting elements of the mating control device in order to supply the demands of the market, and to provide such orientations without substantially increasing manufacturing costs.

SUMMARY OF THE INVENTION

The present invention includes a two-part housing for contact elements. This housing is called an "insert". The insert thus includes an "upper" or first part and a "lower" or second part having generally conforming square or rectangular peripheral shapes with a contact located adjacent each of the four sides (in the illustrated embodiment). The upper (or first) section may be a molded plastic part and it defines four channels for receiving four insulated wires from a feed cable. Each wire channel on the upper section extends from a cable input side and transverses a square recess in the upper housing or section. The lower (or second) housing section also may be a molded plastic part and it includes four square recesses or receptacles, each receiving a contact which aligns with an associated square recess in the top housing section when the upper and lower housing sections are assembled.

Each contact is a conducting body of four sides arranged to form a square tubular base, each side including an IDC contact so that one end of each contact has first and second pairs of IDC contacts aligned on opposing sides of the square tubular base thus providing a pair of IDC contacts for coupling to a wire held in a channel on the upper housing section, whether the contact element is in any one of four quadrature positions.

One side of each contact has an extension that extends through an associated aperture in the upper housing section when the upper and lower sections are assembled for connection to a printed circuit board, for example, above the upper housing section.

Assembly of the upper and lower housing sections, which may desirably be performed by machine, also establishes electrical contact between the four wires held in the four channels respectively in the upper section and the associated respective contacts held in the lower section. The assembled sections (and printed circuit board) may then be overmolded, and a gasket and gasket retainer may be assembled to the underside of the lower section.

Further features and advantages of the present invention will be apparent to persons skilled in the art for the following detail description of a preferred embodiment accompanied by the attached drawings that are on reference numerals referred to like parts in the various views.

DETAILED DESCRIPTION OF THE ILLUSTRATED EMBODIMENT

Figure 1:
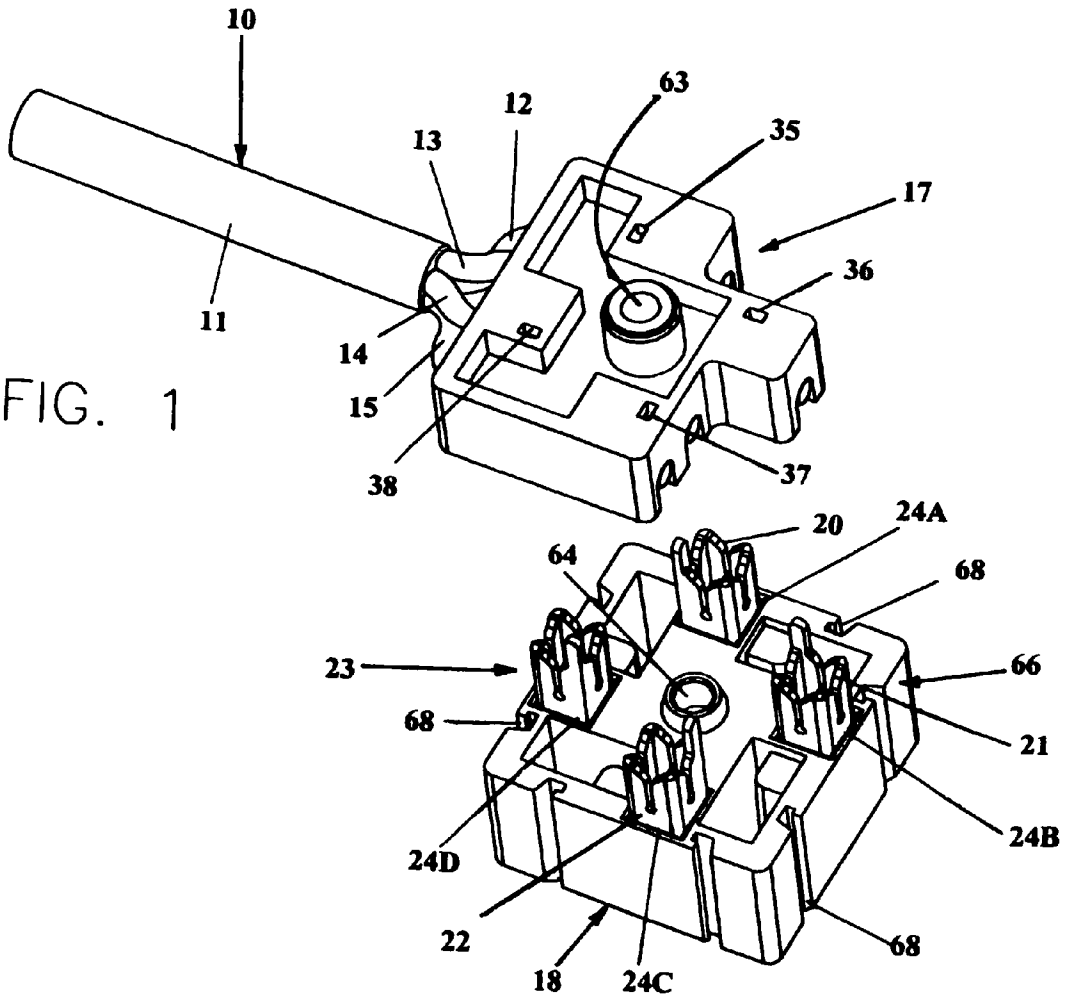
FIG. 1 is an upper perspective view of the inventive connector with the upper housing section and lower housing section in exploded relation.

Turning first to FIG. 1, reference 10 generally designated an electrical cable including a jacket 11 and four individual insulated wires designated respectively 12, 13, 14, and 15.

The wires 12–15 are assembled in a manner to be described, to an upper or first housing section generally designated 17 of the molded connector. The molded connector includes a lower housing section 18 which is adapted to be assembled to the upper section 17 to form a complete housing, as will be described below.

The wires 12–15 are placed in holding or routing channels in the bottom or mating surface of the upper housing section 17, and four insulation displacement contacts (IDC) designated respectively 20–23 in FIG. 1 are supported in recesses or receptacles 24A–24D in the upper or mating surface of the lower housing section 18. When the upper and lower housing sections are assembled and forced together, which preferably may be by machine, the mating surfaces engage and the wires 12–15 connect respectively to the IDC contacts 20–23 using an IDC feature of the contacts to be described. The contacts 20–23 are received in correspondingly sized recesses or receptacles 24A–24D respectively formed in the lower housing section 18. The receptacles 24A–24D are configured to prevent the IDC contacts from turning in the recesses.

Figure 2:
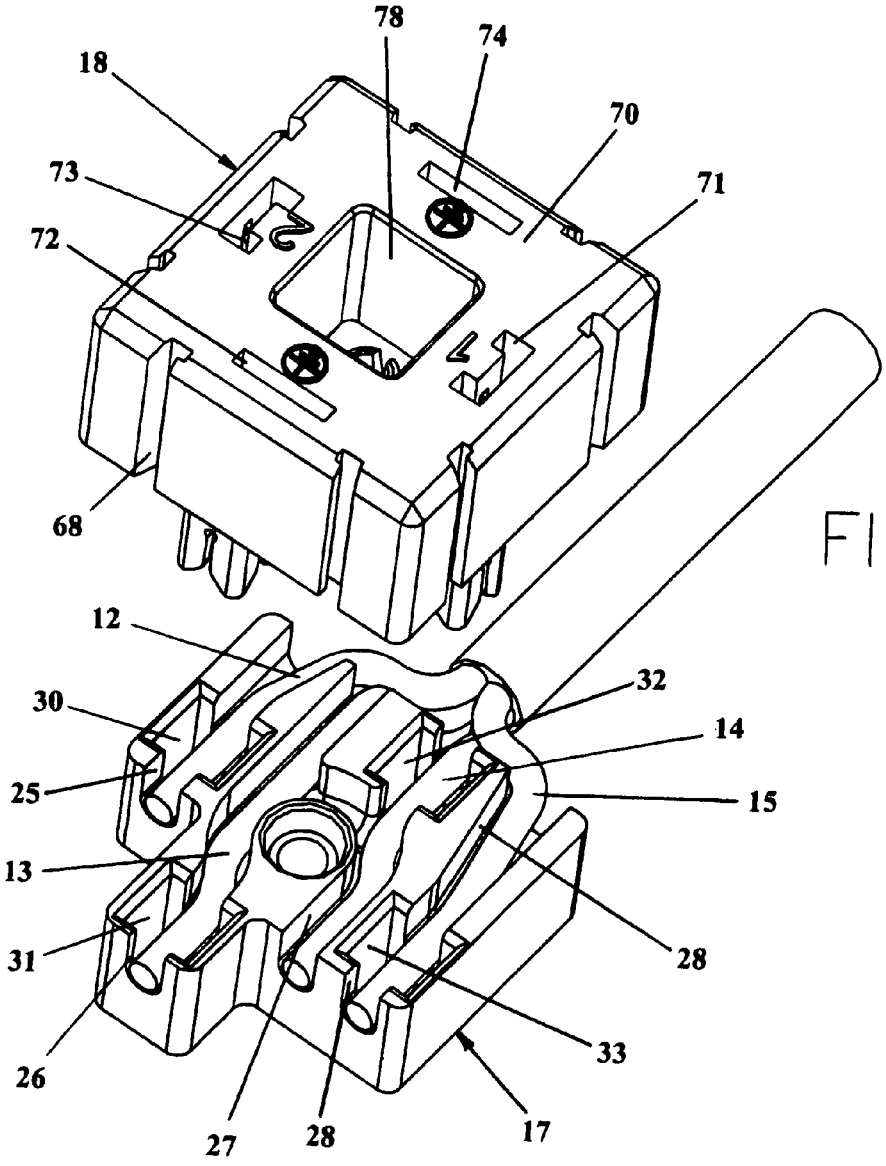
FIG. 2 is a perspective view of the bottom of the connector of FIG. 1 with the upper section and lower sections in exploded relation.

As seen in FIG. 2, the underside or mating surface of the upper section 17 includes four channels or raceways designated respectively 25, 26, 27 and 28 for receiving the wires 12–15 respectively. Intersecting each of the channels 25–28, is a relief area or recess. These recesses are designated 30, 31, 32, and 33 for the channels 25–28 respectively. Each of the recesses 30–33 is generally square in cross section and is adapted to receive the upper portion of an associated contact 20–23 in order to complete the insulation-displacement connection and to secure and seat the upper portion of the associated contact.

Returning to FIG. 1, there are four apertures designated respectively 35, 36, 37 and 38 which extend through the top of the upper section 17 from the recesses 30–33 respectively. That is, there is a throughway from each of the apertures 35–38 and its associated recess 30–33 in the upper housing section 17 to receive an extension of the associated contact as will be described presently.

Figure 4:
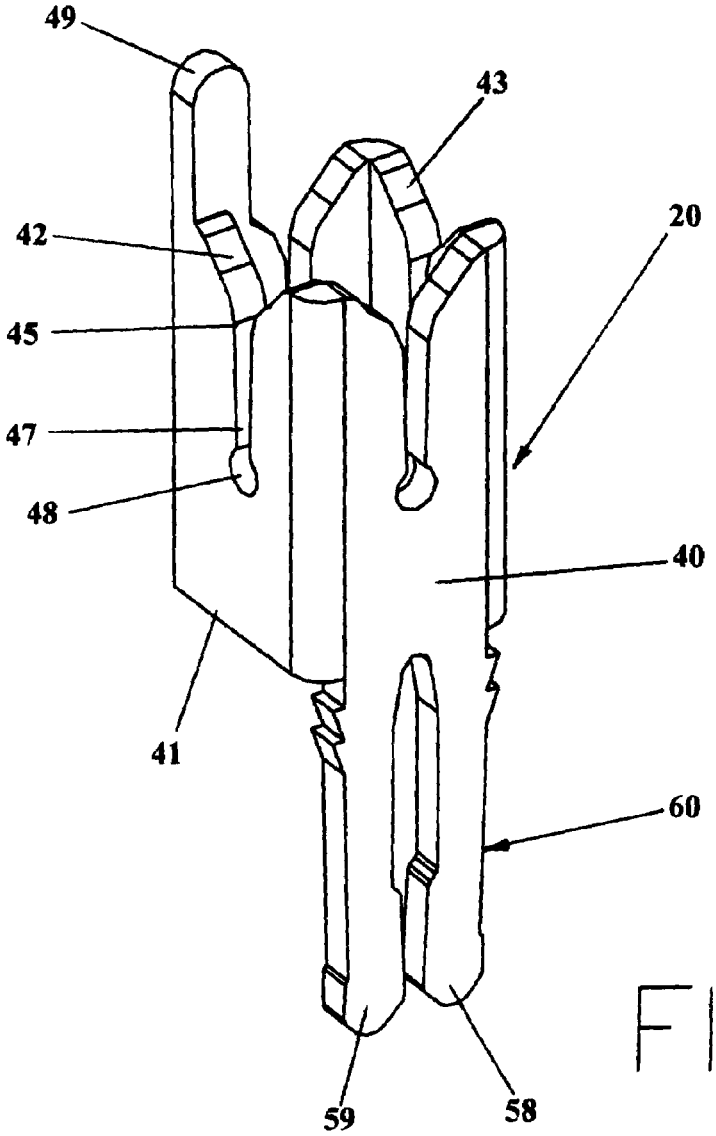
FIG. 4 a perspective view of the IDC contact for the present invention.

Turning now to the contacts, each of the contacts may be identical, so that only one contact need be described in detail for an understanding of the invention. Turning then to FIG. 4, contact 20 is made of conducting metal; and it includes four sidewalls designated respectively 40, 41, 42, and 43 forming a generally square tubular body. Each of the sidewalls 40–43 includes an insulation-displacement connecting structure such as the one designated 45 for the sidewall 41 in FIG. 4. Each of the IDC connecting structures for each of the sidewalls 40–43 is similar in structure so that only the IDC structure 45 will be described in further detail.

The IDC connecting structure 45 includes a widened inlet portion or mouth which opens to engage one of the wires 12–15 when the upper section and lower housing sections are assembled together and the mating surfaces contact. The inlet or guiding portion is designated 46 in FIG. 4, and it leads into an elongated slot 47, the lower portion of which is rounded at 48 to relieve stress as the wire engages and stresses the cutting edges of the slot 47 to effect an electrical continuity between the contact and its associated wire.

It will be observed from FIG. 4 that because the sidewalls 40–43 are arranged in quadrature, and the associated IDC structure of each of the sidewalls is centered on the associated sidewall, the IDC structures on opposing sidewalls 43, 45 are aligned so as to engage and connect separately to the same wire. That is, in the case of contact 20, its upper portion as seen in FIG. 4 would engage the wire 25 and form two independent, opposing IDC connections with the wire 20. The upper portion of the contact 20 will be received within the recess 30 formed in the bottom wall of the upper housing section 17. The same would be true if the contact 20 were rotated 90° or 180° or 270° from the position shown.

Figure 3:
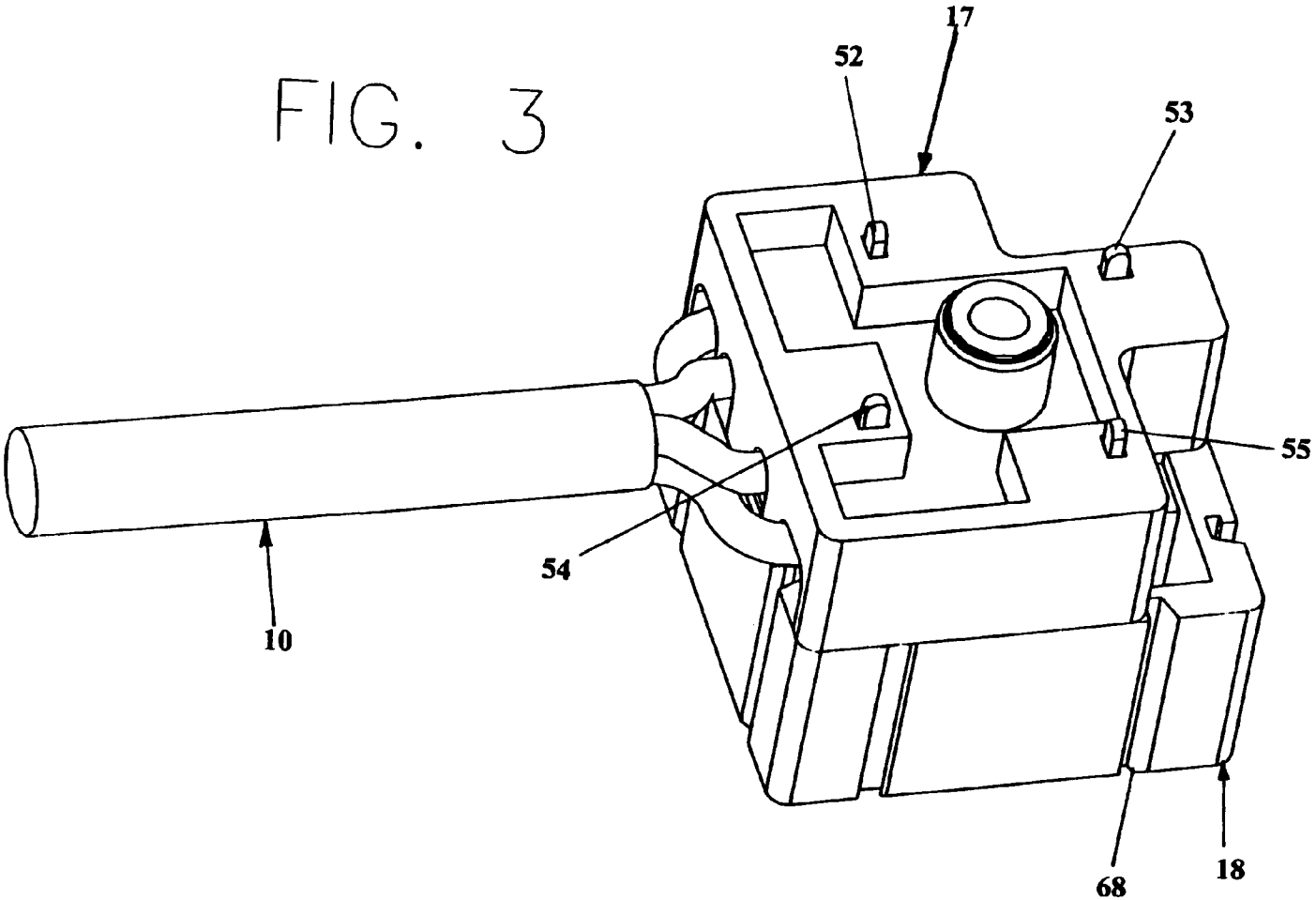
FIG. 3 is an upper perspective view of the connector with the upper section and lower section assembled.

One end of each of the IDC contacts forms an extension, such as the one designated 49 in FIG. 4, which is received in and extends through the aperture 35 in the upper housing section 17, thus extending above the housing and forming a contact extension which extends up above of the top of upper housing section 17 of the connector and is designated 52 in FIG. 3. The corresponding connector extensions for the other contacts 21–23 are designated respectively 53, 54 and 55 in FIG. 3. The purpose of the contact extensions 52–55 is to provide a connection between each contact and an associated printed circuit board designated 76 in FIG. 6 assembled to the top of the upper section 17, as is common in molded connectors of this type.

Returning now to FIG. 4, the lower portion of each of the IDC contacts 20–23 (as oriented in FIG. 4) includes a pair of opposing blades or fingers 58, 59 which form a connecting element 60 for receiving a blade contact of the sensor or other device with which the instant connector couples. That is, a blade contact of a sensor is received between the fingers or blades 58, 59 and extends respectively in the slot defined by the blades 58, 59.

Figure 6:
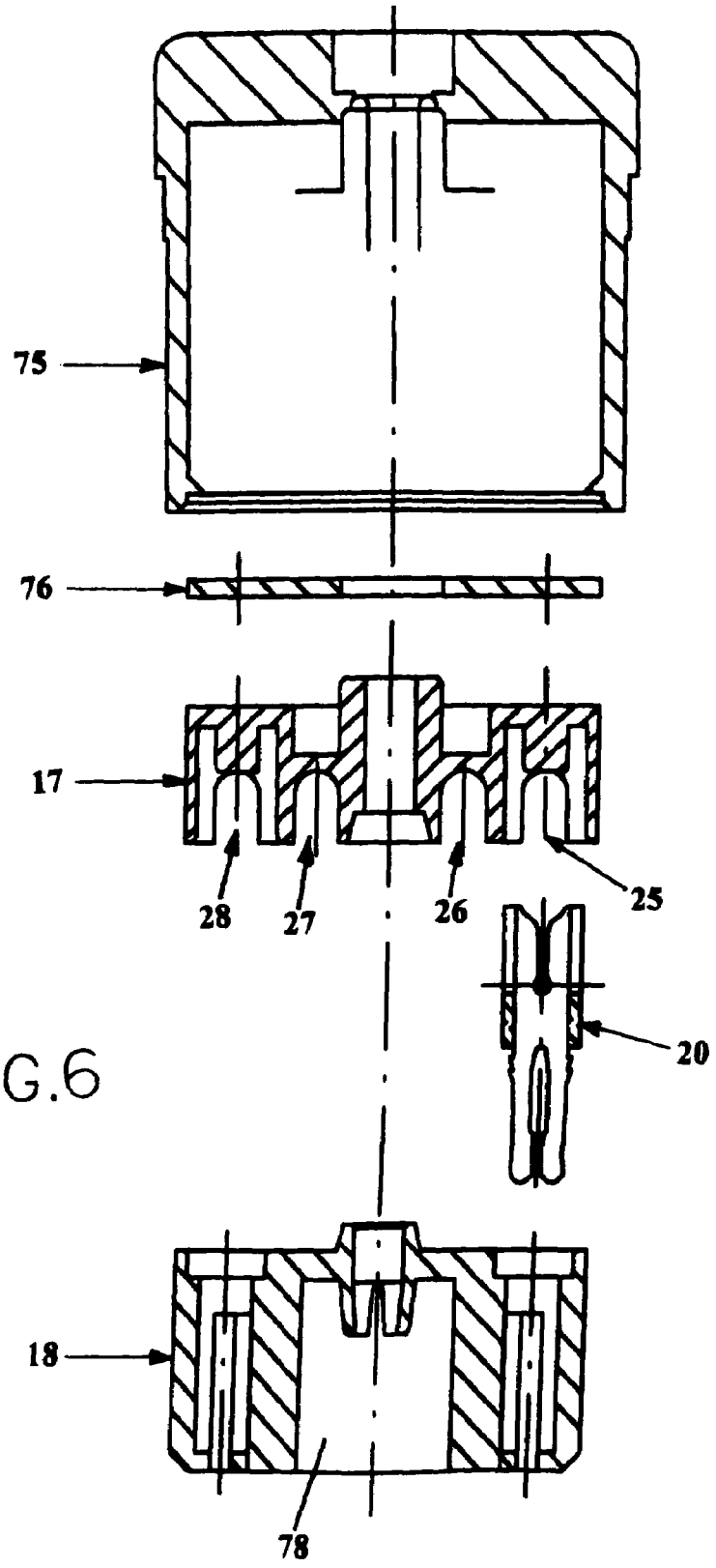
FIG. 6 is a vertical section view of the inventive connector with one IDC contact shown and with the components in exploded relation.

Turning now to FIGS. 1 and 6, the central portion of the upper housing section 17 is provided with an aperture 63 which aligns with a corresponding aperture 64 in the lower housing section 18 when the two housing sections are assembled as seen in FIG. 3. The aligned apertures 63, 64 provide a continuous opening to receive a mounting screw for securing the molded connector to the sensor or other device with which it is intended to couple.

Referring to FIG. 1, it will be seen that the periphery of the lower housing section 18 is generally square and includes an upright sidewall 66 in which a plurality of L-shaped upright slots such as the one designated 68 are formed. The purpose of the slots 68 (which as can be seen in FIG. 1 have three feet portions facing each other on a common wall) is to permit attachment of the overmold material which covers the end of the cable 10, wires 12–15, as well as the upper and lower sections 17, 18 when assembled, except for the opening formed by the aperture 63, 64, and the bottom of the lower section 18. The slots 68 provide a means of securing the overmold sheath to the assembled connector.

Figure 5:
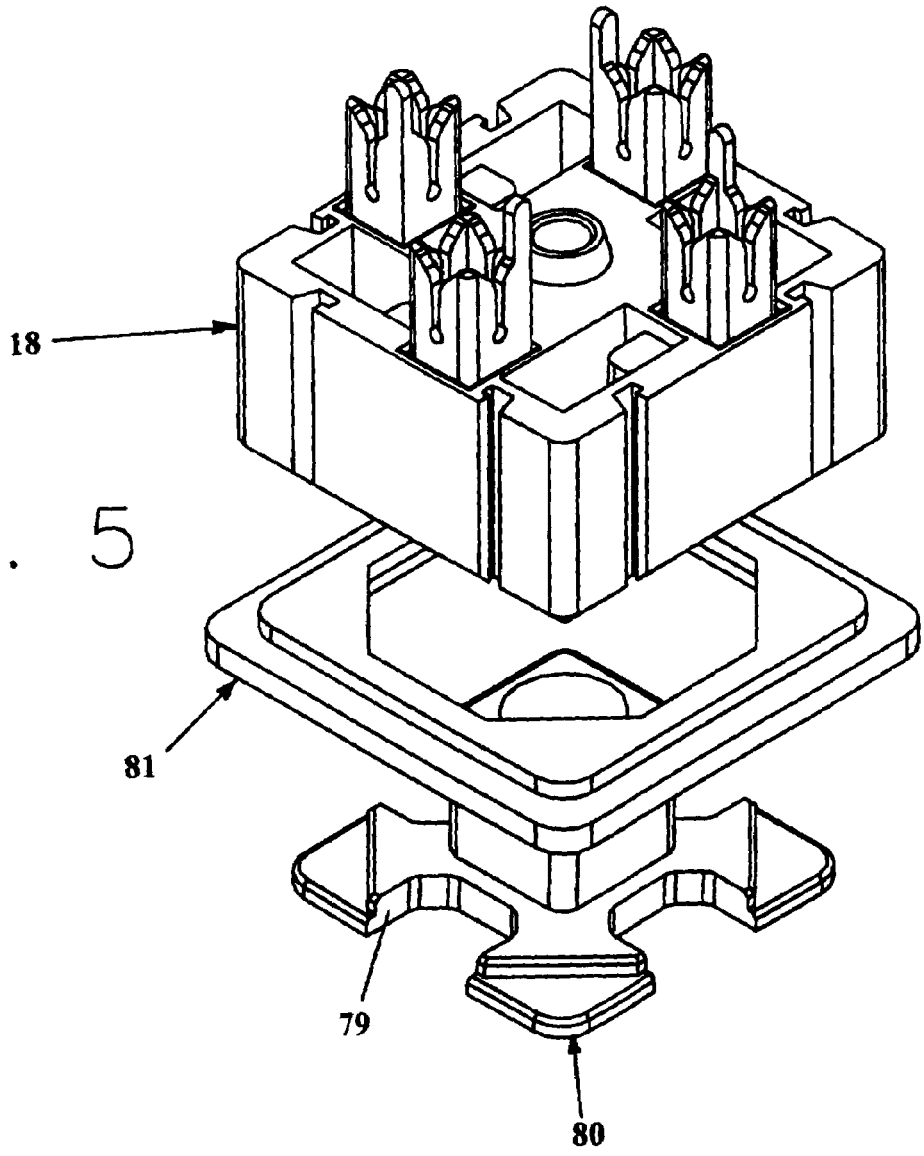
FIG. 5 a perspective view of the connector housing, gasket and gasket retainer in exploded relation.

Turning now to FIG. 2, the underside of the lower section 17 is designated 70, and it includes three C-shaped slots 71, 72, and 73 for receiving corresponding blade contacts of the sensor or device to which a connecter is assembled as well as a straight slot 70 or receiving a blade contact element of the sensor. The configurations illustrated may be changed according to the application. The overmold identified at 75 in FIG. 6 does not cover the bottom wall of the lower housing section or any of the slots 71–74. In the center of the lower housing section 18 is a central cavity 78 which receives a raised center portion 79 (FIG. 5) of a gasket retainer 80. Between the gasket retainer 80 and the lower section 18 is a conventional sealing gasket 81 which is interposed between the lower housing section 18 and the body of the sensor or other device to which the connector is assembled, preferable by a threaded fastener as described above.

Having disclosed a preferred embodiment of the invention having four contacts (the invention is not limited to four contacts but is equally applicable to applications requiring a fewer number of connecting elements), persons skilled in the art will realize that the structure disclosed lends itself to reliable and economic assembly by machine. The wires may be cut to size and routed in the channels 25–28 by machine, the contacts 20–24 may be assembled into their associated recesses 24A–24D in the lower section 18 by means of a machine. The upper and lower housing sections may then be assembled together as seen in FIG. 3 by machine, and this step effects the dual IDC electrical contact for each wire. The overmolding process is accomplished by machine, as well. It will thus be appreciated that the invention as disclosed provides a convenient economical and reliable connector.

I claim:

1. An electrical connector comprising:

first and second sections adapted to mate with one another;

said first section including a plurality of channels each adapted to receive an insulated wire and plurality of first generally square receptacles each disposed in a respective channel;

said second section defining a plurality of second receptacles, each second receptacle being aligned with an associated one of said channels and said first receptacles in said first section when said sections are assembled together; and a contact received in each of said second generally square receptacles of said second section and adapted for insertion in an associated first receptacle when said sections are assembled together, each contact including a pair of opposing sidewalls, each sidewall defining an insulation-displacement connecting structure arranged to pierce the insulation of a wire placed in an associated one of said channels and to establish an electrical connection with an associated wire when said first and second sections are assembled, wherein each contact includes four sidewalls in a generally square arrangement to define two pairs of opposing sidewalls forming a generally square tubular base, one edge of each sidewall defining an insulation displacement connecting structure including a lead-in portion for engaging and guiding an associated wire upon assembly of said first and second sections.

2. The connector of claim 1 characterized in that said insulation-displacement connecting structure of each sidewall of each contact is centered on its associated sidewall, whereby the insulation-displacement connecting structures on opposing sidewalls of said contact connect with the same wire to establish two separate connections with an associated wire when said contact is placed in any of four quadrature positions.

3. The connector of claim 2 wherein said insulation-displacement connecting structure includes a widened guide portion communicating with a narrow slot having opposing insulation cutting edges, and a curved portion joining distal ends of said slot.

4. The connector of claim 1 wherein each contact includes a pair of opposed fingers spaced to receive a connecting element of a device to which said connector may be coupled.

* * * * *